US005236191A

United States Patent [19]

Capriati

[11] Patent Number: 5,236,191

[45] Date of Patent: Aug. 17, 1993

[54] TENNIS TRAINING DEVICE AND METHOD

[76] Inventor: Stefano Capriati, 79C Saddlebrook Way, Wesley Chapel, Fla. 33543

[21] Appl. No.: 763,547

[22] Filed: Sep. 23, 1991

[51] Int. Cl.[5] ..... A63B 69/38

[52] U.S. Cl. ..... 273/29 A; 273/411; 273/73 R; 273/67 B

[58] Field of Search ..... 273/329, 330, 318, 319, 273/320, 321, 67 R, 67 B, 73 R, 73 C, 29 R, 29 A, 76, 331, 411, 412, 413, 414, DIG. 30

[56] References Cited

U.S. PATENT DOCUMENTS

| | | | |
|---|---|---|---|
| 1,523,899 | 1/1925 | Rittenhouse | 273/67 B |
| 1,523,900 | 1/1925 | Rittenhouse | 273/67 B |
| 1,558,666 | 10/1925 | Brewer et al. | 273/67 B |
| 2,142,068 | 12/1938 | Berger | 273/330 |
| 2,269,633 | 1/1942 | Merle | 273/330 |
| 2,987,316 | 6/1961 | Butera | 273/67 B |
| 4,516,774 | 5/1985 | Nankivell | 273/67 B |
| 4,874,168 | 10/1989 | Wright | 273/67 B X |

FOREIGN PATENT DOCUMENTS

| | | | |
|---|---|---|---|
| 444407 | 7/1926 | Fed. Rep. of Germany | 273/67 B |
| 156982 | 9/1939 | Fed. Rep. of Germany | 273/67 B |
| 2261960 | 6/1974 | Fed. Rep. of Germany | 273/67 B |
| 757603 | 12/1933 | France | 273/67 B |
| 2525480 | 10/1983 | France | 273/67 R |
| 0148590 | 6/1981 | German Democratic Rep. | 273/67 B |
| 598833 | 5/1978 | Switzerland | 273/67 B |
| 12632 | of 1891 | United Kingdom | 273/67 B |
| 414017 | 7/1934 | United Kingdom | 273/330 |
| 2030871 | 4/1980 | United Kingdom | 273/67 R |

*Primary Examiner*—V. Millin
*Assistant Examiner*—Sebastiano Passaniti
*Attorney, Agent, or Firm*—Pearne, Gordon, McCoy & Granger

[57] ABSTRACT

A tennis training device including at least one racket frame and a member for holding a player's hand in a fingers-extended position at a location fixed adjacent the center of the racket frame and parallel thereto. A tennis training method, which can use the foregoing tennis training device, is also described which involve inserting a player's hand into a training device that holds the hand in a fingers-extended position at a location fixed adjacent the center of the racket while permitting free articulation of the wrist and swinging the training device in such a manner that the player's hand remains substantially perpendicular to the direction of the swing.

2 Claims, 5 Drawing Sheets

TENNIS TRAINING DEVICE AND METHOD

BACKGROUND OF THE INVENTION

1. Field of the Invention

The present invention pertains to a tennis training device, particularly a device that includes means for holding a player's hand in a fingers-extended position at a fixed location adjacent the center of a racket frame, and a tennis training method.

2. Description of the Related Art

In a properly executed basic tennis stroke, the tennis racket approaches the ball with the racket's face substantially perpendicular to its direction of travel, and the racket strikes the ball and follows-through in the same orientation. This basic stroke emphasizes control over the ball and increases the consistency and predictability with which the ball is returned. Once a player has perfected the basic stroke, modifications can be made to provide for spin, etc.

Most tennis players find it difficult to learn this stroke. The difficulty is thought to arise primarily because in a standard tennis racket, the tennis racket head is displaced relative to the player's hand. While such a displacement assists in producing a powerful tennis stroke, it detracts from the tennis player's ability to concentrate on tennis stroke fundamentals: approaching the ball, meeting the ball, and following through.

Specifically, because of the displacement of the tennis head, it is relatively easy even for experienced players to flip the tennis racket unconsciously. As part of the basic tennis stroke, such a flip is normally undesirable since it reduces control over the ball and lends unpredictability to the position at which the ball will be returned.

SUMMARY OF THE INVENTION

It is therefore an object of the present invention to provide a tennis training device, and a tennis training method, which assists the tennis player in practicing and perfecting a basic tennis stroke.

It is a further object of the present invention to provide a tennis training device, and a method therefor, which allows a player to concentrate on the proper technique for meeting a tennis ball, and specifically which allows a player to practice and to concentrate on approaching a tennis ball with the tennis racket face substantially perpendicular to the direction of its travel, to meet the ball in that position, and to follow through in that position as well.

In one aspect, these objects are achieved through the provision of a tennis training device which includes at least one racket frame and means for holding a player's hand in a fingers-extended position at a location fixed adjacent the center of the racket frame. The means for holding the player's hand may be mounted directly to the racket frame, or may be sandwiched between a pair of racket frames and frictionally held there.

In another aspect, these objects are achieved through the provision of a tennis training device including a pair of rackets mounted in spaced parallel relationship with an insert between the pair of rackets, the insert having a cavity therein for receiving and holding a player's hand in a fingers-extended position at a location fixed adjacent the center of the rackets.

In a further aspect of the invention, these objects are achieved through the provision of a tennis training method, including the steps of inserting a player's hand into a training device that holds the hand in a fingers-extended position fixed adjacent the face of a racket, and striking a ball with the racket while articulating the player's wrist, thereby to cause the player's hand to remain substantially perpendicular to its direction of travel during the stroke.

This brief summary is provided so that the nature of the invention may be understood quickly. A complete understanding of the invention may be obtained by reference to the following description of the preferred embodiments and by reference to the attached drawings, which together form a complete part of this specification.

Figure 8:
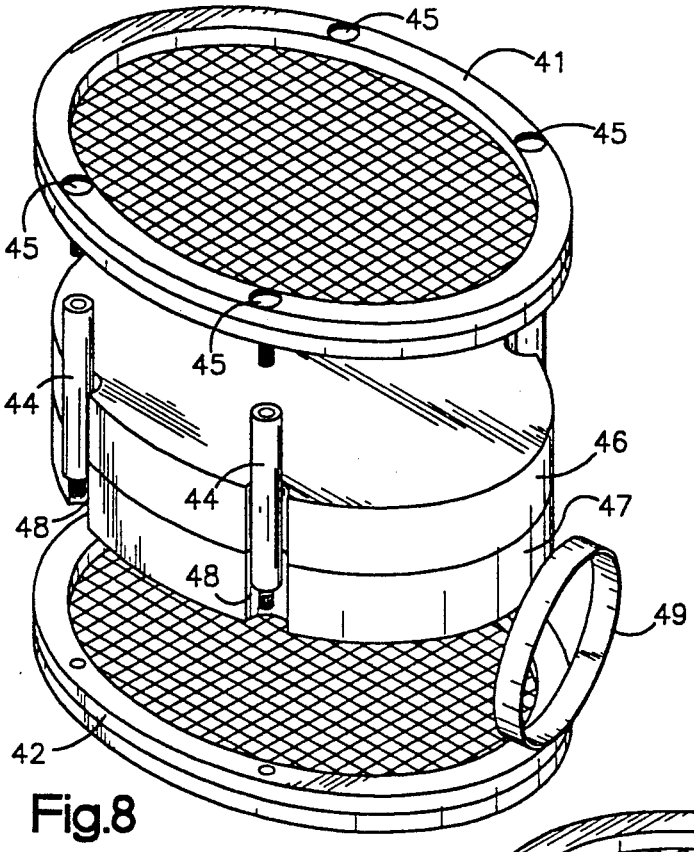
Figure 9:
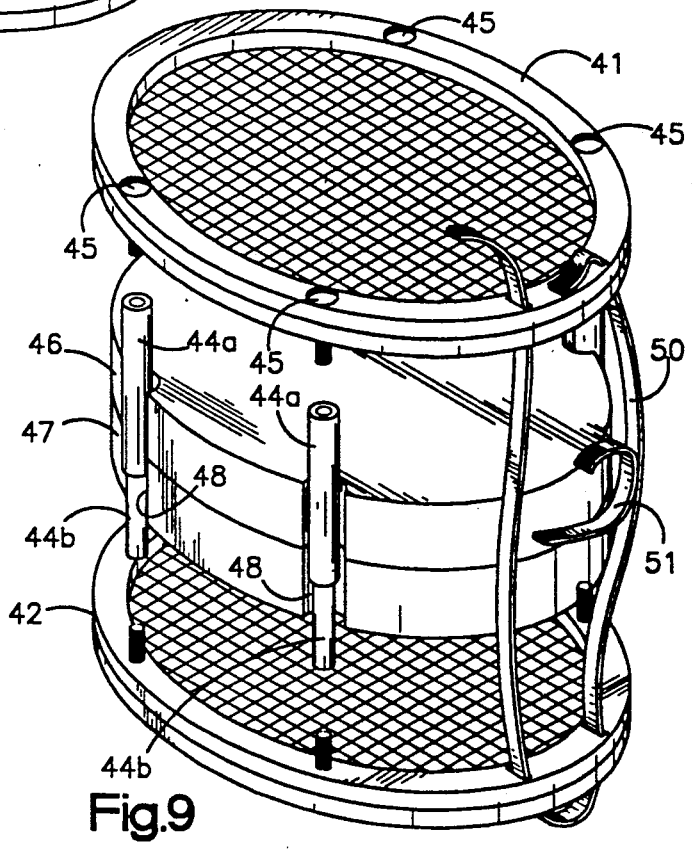

FIGS. *6a–6c* is a diagram for explaining a forehand stroke in the tennis training method of the present invention;

FIGS. *7a–7c* is a diagram for explaining a backhand stroke in a tennis training method according to the present invention;

FIG. 8 is an exploded perspective view of a second embodiment of a tennis training device according to the present invention; and FIG. 9 is an exploded perspective view of a third embodiment of a tennis training device according to the present invention.

DETAILED DESCRIPTION OF THE PREFERRED EMBODIMENTS

Figure 1:
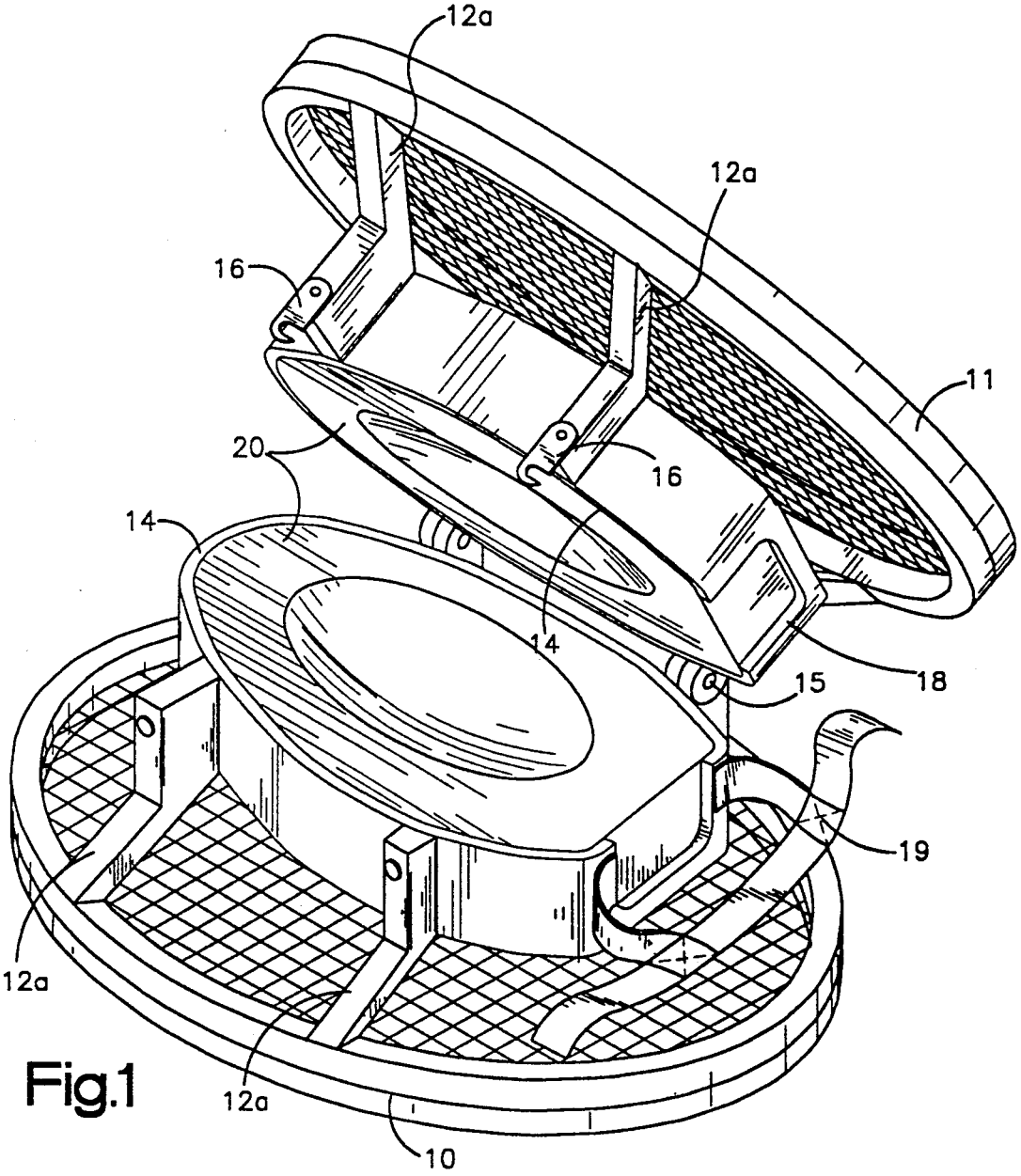
FIG. 1 is a perspective view of a first embodiment of the present invention, which embodiment is shown in an open position.

FIG. 1 shows a perspective view of a tennis training device according to the invention.

As shown in FIG. 1, the device includes first and second tennis frames 10 and 11. Preferably, each of the racket frames is strung with crossed wires, gut or other desired substance as shown. Alternately, it is possible to use a disk or a plate in place of strung frames 10 and 11.

A clam shell-like enclosure 14 is positioned at a fixed location between racket frames 10 and 11 and spaced apart therefrom. The enclosure 14 is segmented in two halves, and each half is connected to respective ones of frames 10 and 11 by plural supports 12.

Figure 4:
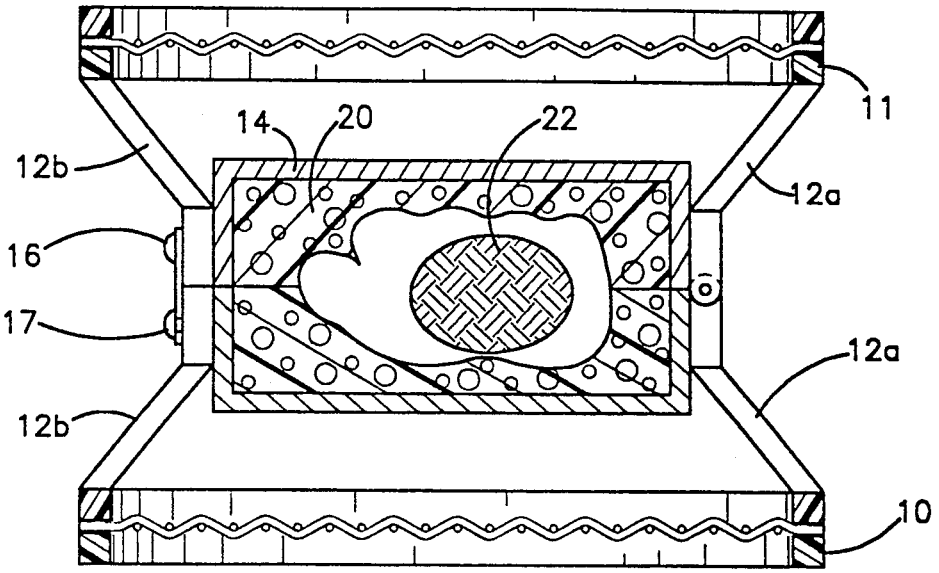
FIG. 4 is a cross-sectional elevational view of the FIG. 1 embodiment taken along the line 4—4 of FIG. 3.
Figure 5:
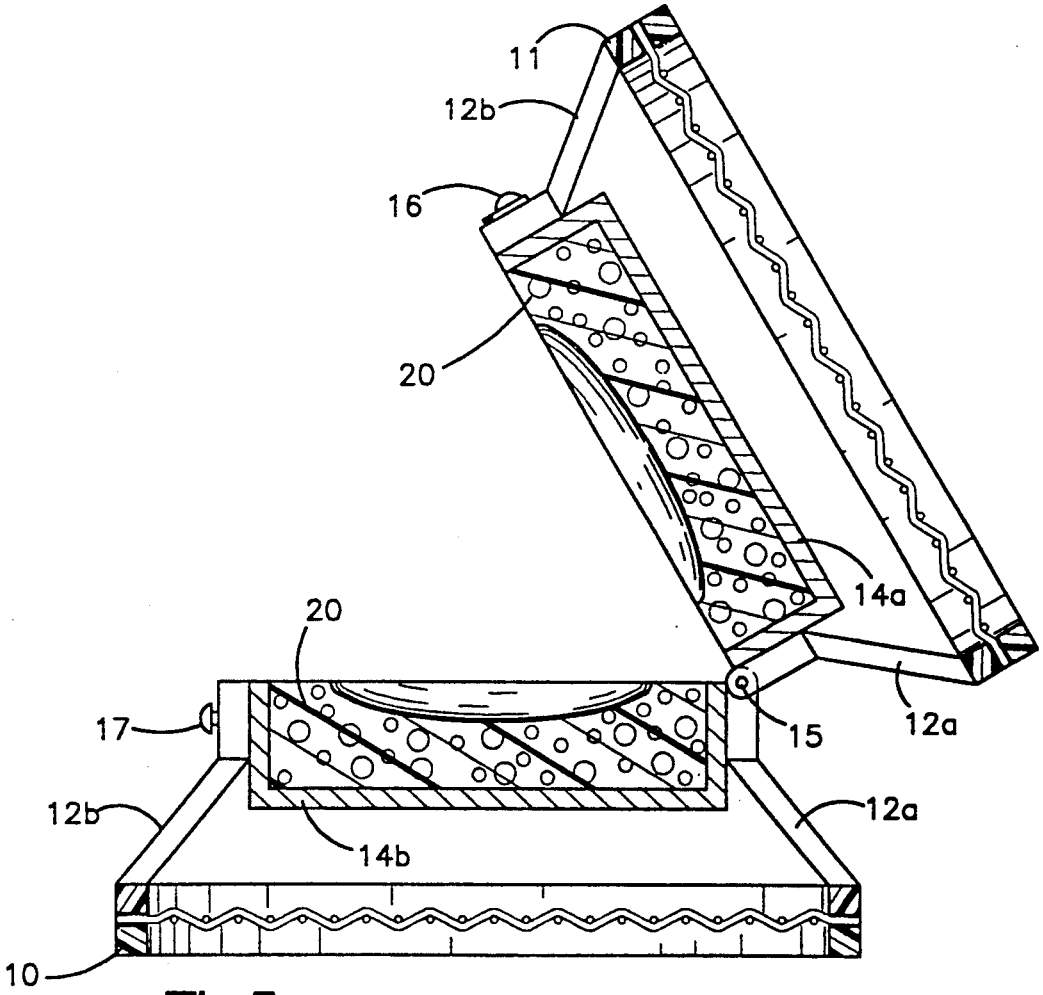
FIG. 5 is a view similar to that of FIG. 4 but with the tennis training device in the open position.

As best seen in FIGS. 4 and 5, supports 12*a* terminate in a hinge 15, while supports 12*b* terminate in a latch 16 and fastener 17 assembly. By virtue of this construction, it is possible to pivot the two racket frames apart from each other as shown in FIG. 5, thereby to separate the respective halves 14*a* and 14*b* of the segmented enclosure 14.

The segmented enclosure 14 is generally void, although this is not essential, and sized to accommodate a player's hand. Corresponding cutouts 18 are provided at one end of each half, to allow the player's hand to enter.

Figure 2:
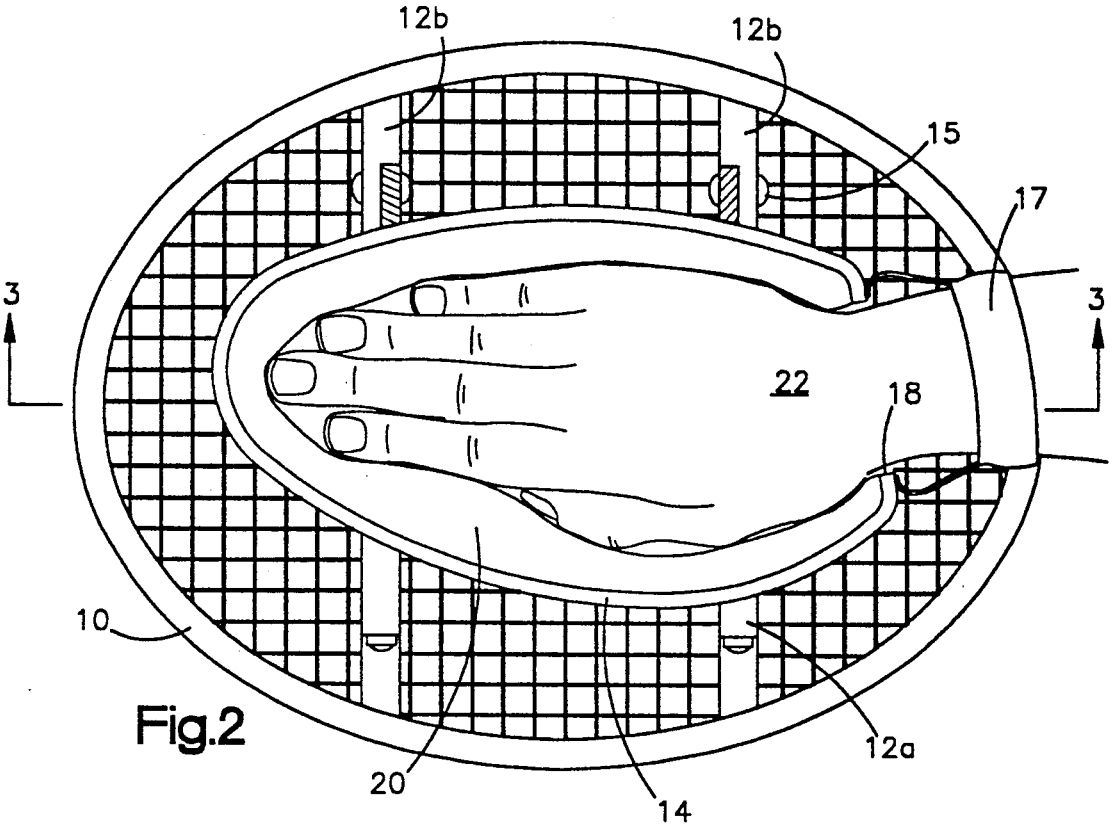
FIG. 2 is a cutaway plan view of the FIG. 1 embodiment.
Figure 3:
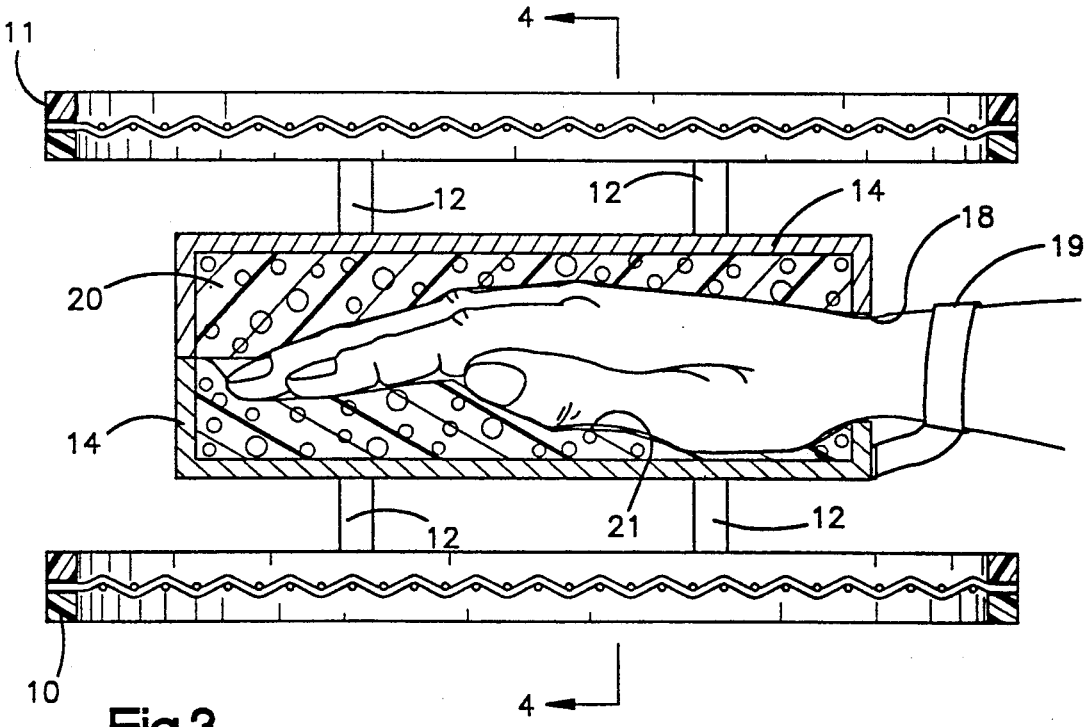
FIG. 3 is a cross-sectional elevational view of the FIG. 1 embodiment taken along the 3—3 line of FIG. 2.

The segmented enclosure may be formed of any suitably rigid material. PVC plastic, because of the ease with which it is molded into arbitrary shapes, is a good choice. The enclosure holds a yieldably stiff filler 20 such as a stiff foam or thermally softenable synthetic polymer resin, similar to materials used in a ski boot or the like. The filler is configured with a cavity 21 adapted to receive a player's hand 22. As best seen in FIGS. 2 and 3, the cavity and the filler are designed to maintain the player's hand in an open palm, fingers-extended position (hereinafter a "fingers-extended position"). Preferably, the fingers of the hand are together, as shown, and there is therefore no need to provide a separate cavity for receiving each finger. The player's hand is thus held rigidly in the fingers-extended position at a fixed location adjacent the center of the racket frames and parallel to the racket frames, yet the player's wrist is free to articulate.

As further shown in FIGS. 2 and 3, the player's hand extends through cutouts 18 in enclosure 14. While these cutouts may be configured in such a manner so as to prevent the device from flying off the player's hand, a wrist strap 19 is preferably provided further to ensure that the device is prevented from flying off the player's hand. The wrist strap uses hook and loop fastening means similar to that sold under the trademark VELCRO to fasten around the player's wrist.

If desired, the enclosure 14 and its filler 20 may be removably provided on supports 12. This construction is advantageous in that it allows individuals to select and maintain their own assembly, which is specially sized to their hand. Thus, the device may be used interchangeably by different individuals.

To use the device, the player's hand 22 is placed inside cavity 21 of enclosure 14. The assembly is rotated about hinge 15, and latch 16 is operated with respect to fastener 17 so as to secure the device in the closed position as shown in FIGS. 2 through 4. If desired, wrist strap 19 may then be secured around the player's wrist.

A tennis training method according to the present invention will now be explained with respect to FIGS. 6 and 7. Although the method is illustrated with the tennis training device of the foregoing embodiment, this should not be considered a limitation.

Figures 6A, 6B, 6C:
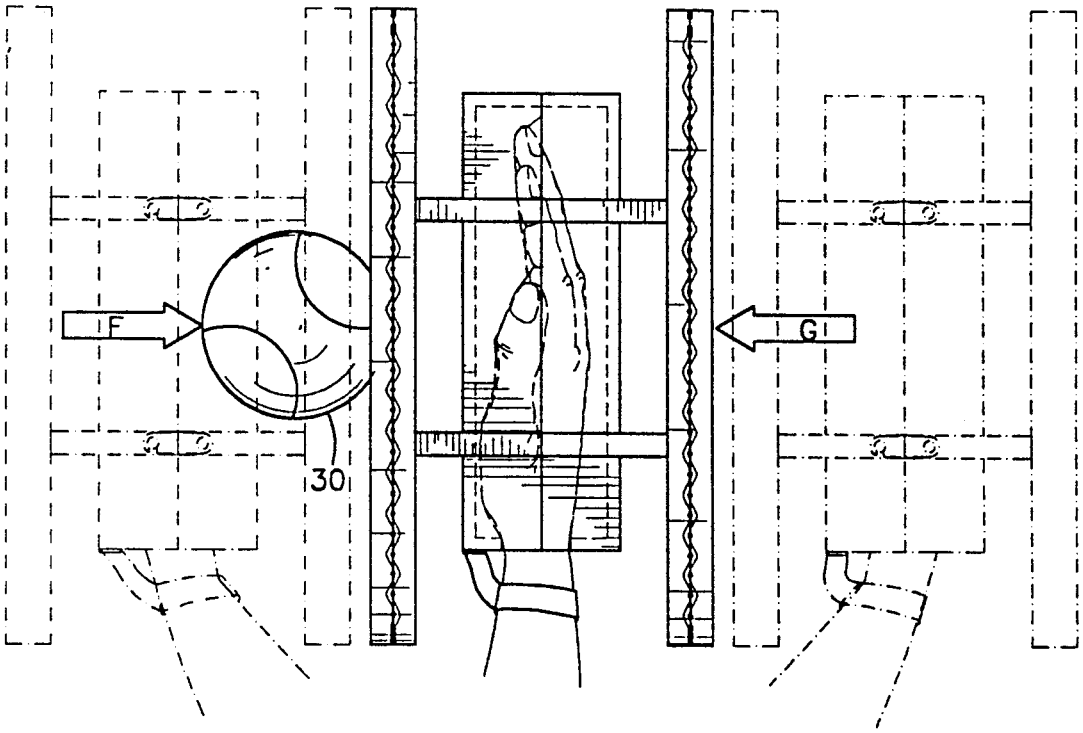
Figures 7A, 7B, 7C:
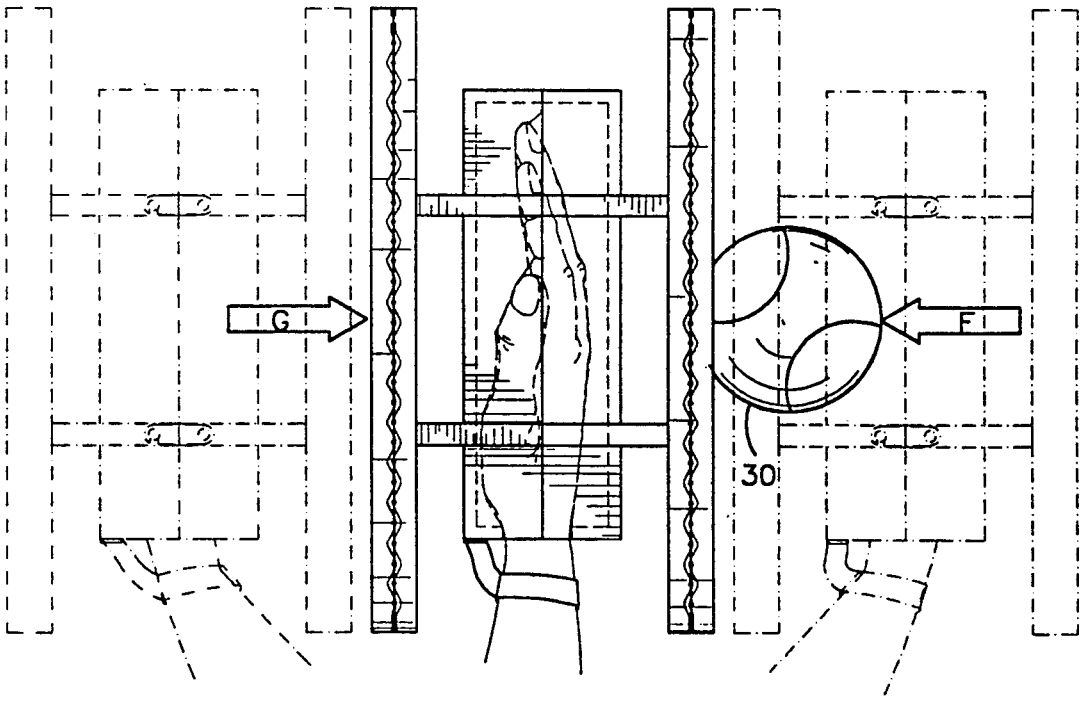

In both FIGS. 6 and 7, a player has inserted his hand into a training device such that his hand is held in a fingers-extended position at a fixed location adjacent the center of the racket face and parallel thereto. The device permits free articulation of the player's wrist.

FIG. 6 shows a training method for a forehand stroke. As shown in FIG. 6, ball 30 is approaching the player in the direction of arrow F. At this time, the player is proceeding to meet the ball and is bringing the tennis training device forward in the direction of arrow G. In the initial stages of approaching the ball, the device is in the position shown at a. The player maintains his hand in position substantially perpendicular to the direction of the stoke (arrow G), thereby also maintaining the face of the device substantially perpendicular to the direction of travel G; the player's wrist has articulated to achieve this orientation.

Continuing his forehand stroke, the player strikes ball 30 at the position indicated by b. In this position, the player's hand and hence the face of the device continue to be substantially perpendicular to the direction of travel. Once again, the player's wrist continues to articulate to achieve this orientation.

In following through after striking the ball, the device continues toward the position indicated at c. Here, the player continues to articulate his wrist so as to maintain the substantially perpendicular orientation of his hand and the face of the device with respect to the direction of travel.

By means of the foregoing stroke, whereby the player's wrist articulates so as to maintain his hand and the face of the device in a substantially perpendicular configuration with respect to the direction of travel during the forehand stroke, the player substantially improves control over the ball, and substantially improves the consistency with which the ball is returned. Because the hand is held in the fingers-extended position substantially parallel to the face of the racket, training by the method shown in FIG. 6 improves the tennis player's intuitive feel of the forehand stroke that should be used when employing a regular tennis racket. Specifically, because the player's hand is immediately proximate the position where the ball is struck, the player can learn and reinforce the proper stroke. Improper movements become immediately apparent to the player. That is, when practicing with a conventional racket, the ball is struck at a position removed from the position of the hand. Movement of the racket face is not immediately apparent to the player due to many factors, for example, the grip, rotation about the racket handle, and the leverage that the racket face exerts against the hand. Therefore, using a conventional racket, it is difficult for a tennis player to achieve the proper forehand stroke. In contrast, in the present method, because the racket face is essentially an extension of the palm of the player's hand, a tennis training method according to the present invention permits the player to reinforce and to visualize the proper forehand stroke.

FIG. 7 depicts a tennis training method for a backhand stroke. As depicted in section a, the player is proceeding to meet tennis ball 30 as it proceeds in the direction of arrow F. The tennis player is beginning his backhand stroke and is moving his hand and the attached racket substantially in the direction of arrow G. During this movement, the wrist is articulated so that the player's hand, which is held in the fingers-extended position, is maintained substantially perpendicular to the direction of movement. The face of the device, therefore, is also maintained in this position.

At b, the tennis ball is struck by the device. At this position, the player has continued to articulate his wrist, thereby to maintain the palm of his hand, and hence the racket face, in a position substantially perpendicular to its direction of movement. This action is carried over into c, where the player is following through on his backhand stroke. At this position, the wrist continues to articulate, thereby to maintain the player's hand and the racket face substantially perpendicular to its direction of movement.

By virtue of the foregoing tennis training method, advantages similar to those obtainable in practicing the inventive method with respect to the forehand stroke, as shown in FIG. 6, are also obtainable. Specifically, because of the proximity of the player's hand with respect to the ball strike position, a tennis player is able to reinforce and to visualize the proper motion of a full-sized conventional tennis racket during a backhand stroke.

FIG. 8 is an exploded perspective view of a second embodiment of a tennis training device according to the present invention. As shown in FIG. 8, the device includes first and second racket frames 41 and 42, respectively, each of which is strung with crossed wires, gut or other desired substances. Alternatively, in place of the strung frames 41 and 42, a disk or plate may be utilized.

Frames 41 and 42 are spaced in parallel relationship by a plurality of spacer tubes 44 located around the periphery of the frames. Each spacer tube 44 is provided with a throughgoing bore. The frames are fixed together by corresponding screws 45 which are inserted from the top of frame 41, through the bore in spacer tubes 44, and bolted in place at the bottom of frame 42. Alternatively, spacer tubes 44 may be provided with threaded bores which accept screws inserted from each racket frame.

Two sheets of resilient material 46 and 47, whose combined thickness is somewhat greater than the length of spacer tubes 44, are sandwiched between the racket frames 41 and 42. The resilient material sheets are cut to a shape corresponding to the outer periphery of the racket frames, and include cut-out portions 48 corresponding to the placement of spacer tubes 44. If desired, a cavity (not shown) may be provided between the sheets.

The resilient material used for sheets 46 and 47 is selected to provide firm yet somewhat yieldable and/or compressible properties Foam rubber has been successfully used in the embodiment shown in FIG. 8. Of course, other materials having similar firmness, resiliency, yieldability and compressibility may be substituted.

Sheets 46 and 47 are sandwiched between racket frames 41 and 42 and are held in place there by a combination of friction and the resistance provided by cutouts 48 against spacer tubes 44. In this regard, by varying the amount by which the length of spacer tubes 44 is shorter than the combined width of sheets 46 and 47 (in their uncompressed state), it is possible to increase the frictional force to any desired extent.

A wrist strap 49 is affixed to one of the racket frames 41 and 42 to prevent the device from slipping from the player's hand when in use.

To use the device, a player's hand is slipped between segments 46 and 47 to separate them, and wrist strap 47 is fastened around the wrist. Sheets 46 and 47 mold to the shape of the hand and hold the hand in the aforementioned fingers-extended position. The hand is held by the sheets in a fixed position at a location adjacent the center of the face of the frames and parallel thereto.

The device depicted in FIG. 8 may be used in the same manner as the first-described embodiment in the practice of the inventive tennis training method.

FIG. 9 shows a third embodiment of the invention which is somewhat similar to the embodiment shown in FIG. 8 but which holds the player's hand more tightly. In FIG. 9, elements that are similar to those shown in FIG. 8 have been marked with the same reference numbers.

In FIG. 9, racket frames 41 and 42 are spaced apart by plural telescoping spacer tubes 44*a* and 44*b*. By this arrangement, the racket frames can be spaced as closely as desired, thereby to compress resilient sheets 46 and 47 and to hold the player's hand more tightly.

The degree of compression, and hence the tightness with which the player's hand is held, is controlled by strap 50. As shown in FIG. 9, strap 50 is fixed to frame 41, extends through a first slot therein down to a complementary first slot in frame 42. The strap loops through a second slot in frame 42 back to a second slot in frame 41. The strap 50 is fastened on frame 41 by hook and loop fastening means such as VELCRO. Tightening strap 50 causes spacer tubes 44 to telescope, thereby permitting any degree of compression to be set and to be held.

If desired, wrist strap 51 may be provided and secured around the player's wrist. In FIG. 9, wrist strap 51 is shown as connected to the midpoint of the leg of strap 50 that extends between complementary slots in frames 41 and 42. Alternatively, strap 50 may simply be looped around the player's wrist.

It may also be desirable to combine the solid spacers 44 shown in FIG. 8 with the telescoping spacers 44*a* and 44*b* shown in FIG. 9. In this case, telescoping spacers 44*a* and 44*b* are positioned adjacent strap 50 and solid spacers 44 are positioned remotely therefrom. With this structure, the racket frames 41 and 42 will pivot around solid spacers 44 when strap 50 draws telescoping spacers 44*a* and 44*b* together. Preferably, solid spacers 44 are provided with a loose fit so as to accentuate the pivoting effect.

The above description of the preferred embodiments of the invention have been provided so that a detailed understanding of the invention may be obtained. However, modifications of the embodiments that do not depart from the scope of the appended claims will be evident to those skilled in the art. Thus, the foregoing description should not be viewed as limiting, and the invention should instead be measured solely with respect to the appended claims.

What is claimed is:

1. A tennis training device comprising at least one racket frame having mounted thereon hinged means for holding a player's hand in a fingers-extended position at a location fixed adjacent a face of the racket frame and parallel thereto, the hinged hand holding means having a plurality of segments being adapted to be separated to facilitate inserting the player's hand; and means to secure the segmented had holding means.

2. A tennis training device comprising at least one racket frame having mounted thereon hinged means for holding a player's hand in a fingers-extended position at a location fixed adjacent a face of the racket frame and parallel thereto, the hinged hand holding means having a plurality of segments being adapted to be separated to facilitate inserting the player's hand; and a latch and fastener to secure the segmented hand holding means.

* * * * *